US012480066B2

(12) United States Patent
Donham et al.

(10) Patent No.: US 12,480,066 B2
(45) **Date of Patent: *Nov. 25, 2025**

(54) ANTIWEAR SYSTEMS FOR IMPROVED WEAR IN MEDIUM AND/OR HEAVY DUTY DIESEL ENGINES

(71) Applicant: Afton Chemical Corporation, Richmond, VA (US)

(72) Inventors: Leah Donham, Henrico, VA (US); Abaigeal Ritzenthaler, Richmond, VA (US)

(73) Assignee: Afton Chemical Corporation

( * ) Notice: Subject to any disclaimer, the term of this patent is extended or adjusted under 35 U.S.C. 154(b) by 0 days.

This patent is subject to a terminal disclaimer.

(21) Appl. No.: 18/822,690

(22) Filed: Sep. 3, 2024

(65) Prior Publication Data

US 2024/0425774 A1 Dec. 26, 2024

Related U.S. Application Data

(63) Continuation of application No. 18/187,932, filed on Mar. 22, 2023, now Pat. No. 12,110,468.

(51) Int. Cl.

| | |
|---|---|
| ***C10M 137/10*** | (2006.01) |
| ***C10M 113/02*** | (2006.01) |
| ***C10M 169/04*** | (2006.01) |
| *C10N 10/04* | (2006.01) |
| *C10N 20/02* | (2006.01) |
| *C10N 30/00* | (2006.01) |
| *C10N 30/06* | (2006.01) |
| *C10N 40/25* | (2006.01) |

(52) U.S. Cl.

CPC ..... *C10M 137/10* (2013.01); *C10M 113/02* (2013.01); *C10M 169/04* (2013.01); *C10M 2201/041* (2013.01); *C10M 2223/045* (2013.01); *C10N 2010/04* (2013.01); *C10N 2020/02* (2013.01); *C10N 2030/06* (2013.01); *C10N 2030/40* (2020.05); *C10N 2040/252* (2020.05)

(58) Field of Classification Search

CPC ..... C10N 2030/40; C10N 2040/252; C10N 2010/04; C10N 2020/02; C10N 2030/06; C10M 137/10; C10M 113/02; C10M 169/04; C10M 2201/041; C10M 2223/045

See application file for complete search history.

(56) References Cited

U.S. PATENT DOCUMENTS

| | | | |
|---|---|---|---|
| 1,857,214 | A | 5/1932 | Rowe |
| 2,995,569 | A | 8/1961 | Hamilton et al. |
| 3,178,663 | A | 4/1965 | Kahn |
| 3,185,647 | A | 5/1965 | Anderson et al. |
| 3,189,544 | A | 6/1965 | Ratner et al. |
| 3,256,185 | A | 6/1966 | Le Suer |
| 3,278,550 | A | 10/1966 | Norman et al. |
| 3,312,619 | A | 4/1967 | Vineyard |
| 3,366,569 | A | 1/1968 | Norman et al. |
| 3,390,086 | A | 6/1968 | O'Halloran |
| 3,403,102 | A | 9/1968 | Le Suer |
| 3,458,530 | A | 7/1969 | Siegel et al. |
| 3,470,098 | A | 9/1969 | O'Halloran |
| 3,471,404 | A | 10/1969 | Myers |
| 3,502,677 | A | 3/1970 | Le Suer |
| 3,519,564 | A | 7/1970 | Vogel |
| 3,546,243 | A | 12/1970 | Coupland |
| 3,573,205 | A | 3/1971 | Lowe et al. |
| 3,634,515 | A | 1/1972 | Piasek et al. |
| 3,649,229 | A | 3/1972 | Otto |
| 3,673,090 | A | 6/1972 | Waldbillig et al. |
| 3,703,504 | A | 11/1972 | Horodysky |
| 3,703,505 | A | 11/1972 | Horodysky et al. |
| 3,708,522 | A | 1/1973 | Le Suer |
| 3,749,695 | A | 7/1973 | de Vries |
| 3,796,661 | A | 3/1974 | Suratwala |
| 3,859,318 | A | 1/1975 | Lesuer |
| 3,865,740 | A | 2/1975 | Goldschmidt |
| 3,865,813 | A | 2/1975 | Gergel |
| 3,873,454 | A | 3/1975 | Horodysky et al. |
| 3,954,639 | A | 5/1976 | Liston |
| 4,119,549 | A | 10/1978 | Davis |
| 4,119,550 | A | 10/1978 | Davis et al. |
| 4,147,640 | A | 4/1979 | Jayne et al. |
| 4,152,499 | A | 5/1979 | Boerzel et al. |
| 4,191,659 | A | 3/1980 | Davis |
| 4,204,969 | A | 5/1980 | Papay et al. |
| 4,234,435 | A | 11/1980 | Meinhardt et al. |

(Continued)

FOREIGN PATENT DOCUMENTS

| | | | |
|---|---|---|---|
| CN | 102575186 | A | 7/2012 |
| DE | 1112067 | B | 8/1961 |

(Continued)

OTHER PUBLICATIONS

Extended European Search Report for European Patent Application EP 24164095.2, dated Jul. 29, 2024.

Huanmou et al., "Lubricity of Carboxyl Acid Derivatives of O,O-dialkyl-phosphorodithioate," Journal of Hunan University, vol. 23, No. 3, (1996), pp. 65-70.

*Primary Examiner* — Vishal V Vasisth

(74) *Attorney, Agent, or Firm* — Honigman LLP

(57) ABSTRACT

The present disclosure relates to lubricating compositions and, in particular, lubricating compositions suitable for medium and/or heavy duty diesel engines having low levels of phosphorus and/or zinc but still achieving good valve train wear by including an antiwear system provided from overbased zinc dihydrocarbyl dithiophosphates having a selected average degree of branching and a certain percent of hydrocarbyl groups derived from secondary alcohols.

18 Claims, No Drawings

(56) References Cited

U.S. PATENT DOCUMENTS

| | | | |
|---|---|---|---|
| 4,240,958 | A | 12/1980 | Braid |
| 4,259,194 | A | 3/1981 | DeVries et al. |
| 4,259,195 | A | 3/1981 | King et al. |
| 4,261,843 | A | 4/1981 | King et al. |
| 4,263,152 | A | 4/1981 | King et al. |
| 4,265,773 | A | 5/1981 | DeVries et al. |
| 4,272,387 | A | 6/1981 | King et al. |
| 4,283,295 | A | 8/1981 | DeVries et al. |
| 4,285,822 | A | 8/1981 | deVries et al. |
| 4,344,854 | A | 8/1982 | Davis et al. |
| 4,379,064 | A | 4/1983 | Cengel et al. |
| 4,472,306 | A | 9/1984 | Powers et al. |
| 4,482,464 | A | 11/1984 | Karol et al. |
| 4,521,318 | A | 6/1985 | Karol |
| 4,554,086 | A | 11/1985 | Karol et al. |
| 4,579,675 | A | 4/1986 | Sawicki et al. |
| 4,612,132 | A | 9/1986 | Wollenberg et al. |
| 4,614,522 | A | 9/1986 | Buckley |
| 4,614,603 | A | 9/1986 | Wollenberg |
| 4,617,137 | A | 10/1986 | Plavac |
| 4,617,138 | A | 10/1986 | Wollenberg |
| 4,636,322 | A | 1/1987 | Nalesnik |
| 4,645,515 | A | 2/1987 | Wollenberg |
| 4,646,860 | A | 3/1987 | Owens et al. |
| 4,647,390 | A | 3/1987 | Buckley, III et al. |
| 4,648,886 | A | 3/1987 | Buckley, III et al. |
| 4,648,980 | A | 3/1987 | Erdman |
| 4,652,387 | A | 3/1987 | Andress, Jr. et al. |
| 4,663,062 | A | 5/1987 | Wollenberg |
| 4,663,064 | A | 5/1987 | Nalesnik et al. |
| 4,666,459 | A | 5/1987 | Wollenberg |
| 4,666,460 | A | 5/1987 | Wollenberg |
| 4,668,246 | A | 5/1987 | Wollenberg |
| 4,670,170 | A | 6/1987 | Wollenberg |
| 4,699,724 | A | 10/1987 | Nalesnik et al. |
| 4,711,736 | A | 12/1987 | Horodysky et al. |
| 4,713,189 | A | 12/1987 | Nalesnik et al. |
| 4,713,191 | A | 12/1987 | Nalesnik |
| 4,859,352 | A | 8/1989 | Waynick |
| 4,948,386 | A | 8/1990 | Sung et al. |
| 4,954,274 | A | 9/1990 | Zaweski et al. |
| 4,963,275 | A | 10/1990 | Gutierrez et al. |
| 4,963,278 | A | 10/1990 | Blain et al. |
| 4,966,720 | A | 10/1990 | DeGonia et al. |
| 4,971,598 | A | 11/1990 | Andress et al. |
| 4,971,711 | A | 11/1990 | Lundberg et al. |
| 4,973,412 | A | 11/1990 | Migdal et al. |
| 4,981,492 | A | 1/1991 | Blain et al. |
| 5,026,495 | A | 6/1991 | Emert et al. |
| 5,030,249 | A | 7/1991 | Herbstman et al. |
| 5,039,307 | A | 8/1991 | Herbstman et al. |
| 5,075,383 | A | 12/1991 | Migdal et al. |
| 5,241,003 | A | 8/1993 | DeGonia et al. |
| 5,334,321 | A | 8/1994 | Harrison et al. |
| 5,362,419 | A | 11/1994 | Zinke et al. |
| 5,578,236 | A | 11/1996 | Srinivasan et al. |
| 5,650,381 | A | 7/1997 | Gatto et al. |
| 5,693,598 | A | 12/1997 | Abraham et al. |
| 5,728,656 | A | 3/1998 | Yamaguchi et al. |
| 5,739,355 | A | 4/1998 | Gateau et al. |
| 5,883,057 | A | 3/1999 | Roell et al. |
| 5,922,657 | A | 7/1999 | Camenzind et al. |
| 6,107,257 | A | 8/2000 | Valcho et al. |
| 6,451,745 | B1 | 9/2002 | Ward |
| 6,586,374 | B1 | 7/2003 | Paul |
| 6,667,281 | B2 | 12/2003 | Ikejima et al. |
| 6,696,363 | B2 | 2/2004 | Lee et al. |
| 6,696,393 | B1 | 2/2004 | Boffa |
| 6,723,685 | B2 | 4/2004 | Hartley et al. |
| 6,903,056 | B2 | 6/2005 | Nagano et al. |
| 7,112,558 | B2 | 9/2006 | Gatto |
| 7,214,649 | B2 | 5/2007 | Loper et al. |
| 7,253,231 | B2 | 8/2007 | Devlin et al. |
| 7,485,603 | B2 | 2/2009 | Bera et al. |
| 7,645,726 | B2 | 1/2010 | Loper |
| 7,732,390 | B2 | 6/2010 | Kadkhodayan et al. |
| 7,786,057 | B2 | 8/2010 | Bera et al. |
| 7,897,696 | B2 | 3/2011 | Huang et al. |
| 8,048,831 | B2 | 11/2011 | Loper |
| 8,143,202 | B2 | 3/2012 | Peer et al. |
| 8,400,030 | B1 | 3/2013 | Tang et al. |
| 8,563,486 | B2 | 10/2013 | Tsujimoto et al. |
| 8,664,169 | B2 | 3/2014 | Bouffet |
| 8,901,052 | B2 | 12/2014 | Sagawa et al. |
| 8,999,904 | B2 | 4/2015 | Matsui et al. |
| 9,522,972 | B2 | 12/2016 | Visger et al. |
| 9,598,658 | B2 | 3/2017 | Scanlon et al. |
| 9,896,634 | B2 | 2/2018 | Gao et al. |
| 9,944,877 | B2 | 4/2018 | Gao et al. |
| 11,111,454 | B2 | 9/2021 | David et al. |
| 11,130,927 | B2 | 9/2021 | Horita et al. |
| 11,578,287 | B1 | 2/2023 | Giles et al. |
| 2006/0063685 | A1 | 3/2006 | Purmer et al. |
| 2006/0205614 | A1 | 9/2006 | Artman et al. |
| 2006/0264340 | A1 | 11/2006 | Iyer et al. |
| 2007/0037715 | A1 | 2/2007 | Okada |
| 2008/0194438 | A1 | 8/2008 | Bera et al. |
| 2008/0194442 | A1 | 8/2008 | Watts et al. |
| 2008/0302422 | A1 | 12/2008 | Neveu et al. |
| 2009/0233822 | A1 | 9/2009 | Iyer |
| 2009/0233823 | A1 | 9/2009 | Fahl et al. |
| 2009/0318316 | A1 | 12/2009 | Morishima |
| 2012/0101017 | A1 | 4/2012 | Duggal |
| 2012/0208731 | A1 | 8/2012 | Lann et al. |
| 2012/0283159 | A1 | 11/2012 | Matsui et al. |
| 2013/0008756 | A1 | 1/2013 | Noles, Jr. et al. |
| 2013/0196888 | A1 | 8/2013 | Truong-Dinh |
| 2013/0244917 | A1 | 9/2013 | Obrecht et al. |
| 2014/0038866 | A1 | 2/2014 | Barton |
| 2014/0097059 | A1 | 4/2014 | Tang et al. |
| 2014/0107000 | A1 | 4/2014 | Ivancic et al. |
| 2014/0249061 | A1 | 9/2014 | Youn et al. |
| 2014/0296118 | A1 | 10/2014 | Costello et al. |
| 2014/0342960 | A1 | 11/2014 | Miller et al. |
| 2015/0210953 | A1 | 7/2015 | Davies |
| 2015/0247104 | A1 | 9/2015 | Brekan et al. |
| 2015/0322322 | A1 | 11/2015 | Sondjaja et al. |
| 2015/0344808 | A1 | 12/2015 | Lagona et al. |
| 2016/0108337 | A1 | 4/2016 | Abraham et al. |
| 2017/0015930 | A1 | 1/2017 | Fletcher et al. |
| 2017/0130161 | A1 | 5/2017 | Vettel et al. |
| 2017/0137739 | A1 | 5/2017 | Narine et al. |
| 2017/0306259 | A1 | 10/2017 | Ding et al. |
| 2018/0072962 | A1 | 3/2018 | Wada et al. |
| 2018/0079990 | A1 | 3/2018 | Aoyama |
| 2018/0100114 | A1 | 4/2018 | Gao et al. |
| 2018/0100115 | A1 | 4/2018 | Gao et al. |
| 2018/0100117 | A1 | 4/2018 | Flores-Torres et al. |
| 2018/0100118 | A1 | 4/2018 | Flores-Torres et al. |
| 2018/0100119 | A1 | 4/2018 | Aoyama |
| 2018/0134983 | A1 | 5/2018 | Broutin et al. |
| 2018/0327687 | A1 | 11/2018 | Kwak |
| 2018/0346839 | A1 | 12/2018 | Fletcher |
| 2019/0002785 | A1 | 1/2019 | Sanson et al. |
| 2019/0002790 | A1 | 1/2019 | Sanson et al. |
| 2019/0024007 | A1 | 1/2019 | Lim et al. |
| 2019/0112541 | A1 | 4/2019 | Hamachi |
| 2019/0177651 | A1 | 6/2019 | Loper et al. |
| 2019/0367830 | A1 | 12/2019 | Iwai |
| 2020/0033218 | A1 | 1/2020 | Sato et al. |
| 2020/0248095 | A1 | 8/2020 | Guerin |
| 2020/0277541 | A1 | 9/2020 | Meyke et al. |
| 2020/0277542 | A1 | 9/2020 | Salvi et al. |
| 2021/0139805 | A1 | 5/2021 | Champagne |
| 2021/0179961 | A1 | 6/2021 | Nga et al. |
| 2021/0253928 | A1 | 8/2021 | Lacroix et al. |
| 2021/0253971 | A1 | 8/2021 | Lacroix et al. |
| 2021/0277322 | A1 | 9/2021 | Lacroix et al. |

FOREIGN PATENT DOCUMENTS

| | | | |
|---|---|---|---|
| EP | 612839 | A1 | 8/1994 |
| EP | 0894845 | A1 | 2/1999 |
| EP | 0768366 | B1 | 6/2001 |

(56) References Cited

FOREIGN PATENT DOCUMENTS

| | | | |
|---|---|---|---|
| EP | 1233054 | A1 | 8/2002 |
| EP | 1262538 | A2 | 12/2002 |
| EP | 0856042 | B1 | 1/2003 |
| EP | 1529831 | A2 | 5/2005 |
| EP | 2446004 | A1 | 5/2012 |
| EP | 2245124 | B1 | 5/2016 |
| GB | 1065595 | A | 4/1967 |
| GB | 2140811 | A | 12/1984 |
| JP | H09111271 | A | 4/1997 |
| JP | 2003027077 | A | 7/2001 |
| JP | 2004-68021 | A | 3/2004 |
| JP | 2006-283026 | A | 10/2006 |
| JP | 2009242547 | A | 10/2009 |
| JP | 2012031359 | A | 2/2012 |
| JP | 2014025081 | A | 2/2014 |
| JP | 2015098592 | A | 5/2015 |
| JP | 2019533736 | A | 11/2019 |
| JP | 2020-527633 | A | 9/2020 |
| WO | 2014186318 | A1 | 11/2014 |
| WO | 2017189277 | A1 | 11/2017 |
| WO | 2017210388 | A1 | 12/2017 |
| WO | 2018139130 | A1 | 8/2018 |
| WO | 2022195502 | A1 | 9/2022 |

ANTIWEAR SYSTEMS FOR IMPROVED WEAR IN MEDIUM AND/OR HEAVY DUTY DIESEL ENGINES

RELATED APPLICATIONS

The present application is a continuation application of U.S. Ser. No. 18/187,932, now U.S. Pat. No. 12,110,468, filed Mar. 22, 2023, wherein the entirety of the aforementioned application is incorporated herein by reference.

TECHNICAL FIELD

The present disclosure relates to lubricating compositions and, in particular, lubricating compositions suitable for improving valve train wear in medium and/or heavy duty diesel engines.

BACKGROUND

Lubricants designed for compression ignition diesel engines, such as medium or heavy duty diesel engines, tend to be focused on suitability for diesel engines operating under severe conditions for either over the road or off-road applications. Medium duty diesel engines are generally configured for trucks weighing between 14,000 and 26,000 pounds while heavy duty diesel engines are generally configured for trucks weighing over 26,000 pounds. Lubricants for such engines often have different requirements than passenger car diesel lubricants in view of the rather harsh operating conditions the engines endure. For example, heavy duty diesel engines, like the Cummins ISB, often include exhaust gas recirculation (EGR) systems to aid in $NO_x$ emissions reduction. However, EGR systems often increase soot accumulation in the crankcase lubricant. Lubricants for such applications, therefore, tend to be more focused on performance in sustained high load and/or higher temperature operations and/or configured to maintain friction and viscosity performance in the presence of soot and/or sludge that may be problematic in medium and heavy duty applications having EGR systems.

In medium and heavy duty engines with EGR systems, the accumulation of lubricant soot can impact valve train wear over time. The valve train in such engines includes valves, crossheads, rocker arms, push rods, tappets, and camshafts that operate to open and close the intake and exhaust valves during engine operation. The Cummins ISB Engine Lubricant Test, as set forth in ASTM D7484-21b, is a performance test designed to evaluate valve train wear and, in particular, cam shaft wear and tappet wear when operating the engine under conditions to accelerate soot production and associated valve train wear.

Automotive and truck manufacturers continue to the push for improved efficiency, fluid longevity, and fuel economy, and as such, demands on engines, lubricants, and their components continue to increase. These requirements also mean engine oil performance must evolve to meet the higher demands of such modern engines and their corresponding performance criteria tied to their unique use and applications. With such exacting demands for engine oils, lubricant manufacturers often tailor lubricants and their additives to meet certain performance requirements for industry and/or manufacturer applications. Typically, industry standards and/or automotive/truck manufacturers require certain performance standards such that a lubricant designed for one use or application may not satisfy all the performance specifications for a different use or application. Heightened demands, such as those for medium and heavy duty diesel engines, have caused challenges when developing lubricants meeting all performance criteria.

SUMMARY

In one aspect, the present disclosure relates to a medium and/or a heavy duty diesel engine crankcase lubricant configured to reduce valve train wear. In one embodiment or approach of this aspect, the lubricant includes one or more base oils of lubricating viscosity; an antiwear system providing no more than about 500 ppm of phosphorus and/or no more than about 500 ppm of zinc from one or more overbased zinc dihydrocarbyl dithiophosphate compounds including hydrocarbyl groups bonded to a phosphorus atom through an oxygen linker. The hydrocarbyl groups of the antiwear system are preferably provided from secondary alcohols or combinations of secondary and primary alcohols and the hydrocarbyl groups preferably have an average degree of branching of no more than about 0.72 and at least about 50 weight percent of the hydrocarbyl groups are derived secondary alcohols. Additionally, the one or more overbased zinc dihydrocarbyl dithiophosphate compounds of the antiwear systems herein preferably have a zinc-to-phosphorous weight ratio of less than about 1.12:1.

In other approaches or embodiments, the medium and/or or heavy duty crankcase lubricant of the previous paragraph may have one or more optional features or optional embodiments in any combination. These optional features or embodiments may include one or more of the following: wherein the one or more overbased zinc dihydrocarbyl dithiophosphate compounds of the antiwear system have a zinc-to-phosphorus weight ratio of about 1.0:1 to 1.12:1; and/or wherein the hydrocarbyl groups of the antiwear system have an average chain length of 5 to 7 total carbons; and/or wherein at least about 60 weight percent of the hydrocarbyl groups in the antiwear system are derived from secondary alcohols; and/or wherein, when tested according to the Cummins ISB Engine Test (ASTM D7484-21b), the lubricants herein result in an Average Cam Shaft Wear (ACSW) of 55 μm or lower and/or an Average Tappet Mass Loss (ATWL) of 100 mg or lower; and/or wherein the lubricant includes, on average, between 2.9 and 3.2 weight percent soot (or, on average, at least about 3 weight percent soot pursuant to ASTM D7484-21b)); and/or wherein the antiwear system includes hydrocarbyl groups derived from alcohols having an average degree of branching of about 0.2 to about 0.72, an average chain length of 5 to 7 total carbons, and at least about 60 weight percent of the hydrocarbyl groups are derived from secondary alcohols; and/or wherein the antiwear system provides no more than about 350 ppm of phosphorus and/or no more than about 350 ppm of zinc; and/or wherein the one or more overbased zinc dihydrocarbyl dithiophosphate compounds of the antiwear system have a structure of Formula I:

(Formula I)

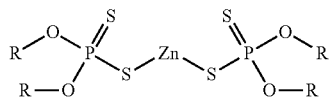

wherein each R group is, independently, a linear or branched C3 to C16 hydrocarbyl group; and/or wherein each R group is, independently, a linear or branched C3 to C8 hydrocarbyl group; and/or wherein the one or more overbased zinc dihydrocarbyl dithiophosphate compounds of the antiwear system have about 60 weight percent to about 75 weight percent of the R groups derived from secondary alcohols; and/or wherein the hydrocarbyl groups of the antiwear system are selected from one or more of ethylhexyl groups, butyl groups, methyl isobutyl groups, pentyl groups, methyl pentyl groups, isopentyl groups, isobutyl groups, propyl groups, isopropyl groups, or combinations thereof; and/or wherein the lubricant meets or exceeds the specifications of one or more of API CJ-4, CK-4, and/or FA-4.

In another aspect, the present disclosure also relates to a method of lubricating a diesel engine, such as a medium and/or heavy duty diesel engine, to reduce valve train wear. In embodiments or approaches of this aspect, the method includes lubricating a medium or heavy duty diesel engine with a crankcase lubricant; wherein the crankcase lubricant includes (i) one or more base oils of lubricating viscosity and (ii) an antiwear system providing no more than about 500 ppm of phosphorus and/or no more than about 500 ppm of zinc from one or more overbased zinc dihydrocarbyl dithiophosphate compounds including hydrocarbyl groups bonded to a phosphorus atom through an oxygen linker; wherein the hydrocarbyl groups of the antiwear system are provided from primary alcohols, secondary alcohols, or combinations thereof having an average degree of branching of no more than about 0.72 and at least about 50 weight percent of the hydrocarbyl groups are derived from secondary alcohols; and wherein the one or more overbased zinc dihydrocarbyl dithiophosphate compounds of the antiwear system herein have a zinc-to-phosphorus weight ratio of less than about 1.12:1, and wherein the lubrication of the medium or heavy duty diesel engine results in an Average Cam Shaft Wear (ACSW) of 55 μm or lower and/or an Average Tappet Mass Loss (ATWL) of 100 mg or lower in the Cummins ISB Engine Test (ASTM D7484-21b).

In other embodiments or approaches, the above-described method may include optional features, steps, and/or embodiments in any combination. These optional features, steps, and/or embodiments of the methods may include one or more of the following: wherein the medium or heavy duty diesel engine is equipped with an exhaust gas recirculation system; and/or wherein the crankcase lubricant meets or exceeds the specifications of one or more of API CJ-4, CK-4, and/or FA-4; and/or wherein the crankcase lubricant has, on average, at least about 3 weight percent soot (or, on average, between about 2.9 and about 3.2 weight percent soot as set forth in ASTM D7484-21b); and/or wherein the antiwear system includes hydrocarbyl groups provided from alcohols having an average degree of branching of about 0.2 to about 0.7, an average chain length of 5 to 7 total carbons, and at least about 60 weight percent of the hydrocarbyl groups are derived from secondary alcohols; and/or wherein the antiwear system provides no more than about 350 ppm of phosphorus and/or no more than about 350 ppm of zinc; and/or wherein the one or more overbased zinc dihydrocarbyl dithiophosphate compounds of the antiwear system have a structure of Formula I:

(Formula I)

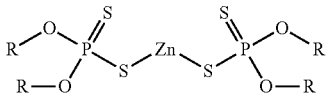

wherein each R group is independently a linear or branched C3 to C16 hydrocarbyl group; and/or wherein each R group is independently a linear or branched C3 to C8 hydrocarbyl group and derived predominately from secondary alcohols; and/or wherein the one or more overbased zinc dihydrocarbyl dithiophosphate compounds of the antiwear system have about 60 weight percent to about 80 weight percent of the R groups derived from secondary alcohols; and/or wherein the hydrocarbyl groups of the antiwear system are selected from one or more of ethylhexyl groups, butyl groups, methyl isobutyl groups, pentyl groups, methyl pentyl groups, isopentyl groups, isobutyl groups, propyl groups, isopropyl groups, or combinations thereof.

In yet another aspect, the present disclosure also relates to the use of any embodiment of the medium and/or a heavy duty diesel engine crankcase lubricant as described above in this Summary for achieving an Average Cam Shaft Wear (ACSW) of 55 μm or lower and/or an Average Tappet Mass Loss (ATWL) of 100 mg or lower in the Cummins ISB Engine Test (ASTM D7484-21b).

DETAILED DESCRIPTION

The present disclosure relates to lubricating compositions configured for medium and/or heavy duty diesel engines, such as but not limited to a Cummins ISB engine and the like, and also to methods of lubricating the medium and/or heavy duty diesel engines, having EGR systems, to reduce valve train wear. As noted in the Background, medium and/or heavy duty diesel engines often include EGR systems that recirculate a portion of the engine's exhaust gas back to the engines cylinders to aid in $NO_x$ emissions reduction. However, such exhaust gas recirculation tends to also recirculate soot to the engine, which can accumulate in the lubricant over time. Soot in the lubricant can impact wear on the valve train tappets and camshafts.

The Cummins ISB Engine Lubricant Test, as set forth in ASTM D7484-21b, evaluates the impact of a lubricant having a certain amount of soot on the durability and reliability of the valve train and, in particular, the camshaft and tappet interface. Zinc dihydrocarbyl dithiophosphate compounds (ZDDPs) are commonly added to medium and/or heavy duty lubricants as antiwear agents. However, trends in emissions control often require lower levels of zinc and/or phosphorus to reduce impact on emissions after treatment systems. Thus, lubricant developers have a conflicting dilemma with use of the ZDDPs in lubricants for diesel engines whereby reducing this additive may improve performance of emissions after treatment systems at the expense of wear performance.

The present disclosure describes a crankcase lubricant configured for medium and/or heavy duty diesel engines with lower levels of phosphorus and/or zinc from an antiwear system including ZDDPs. The lubricants herein, having reduced zinc and/or phosphorus content surprisingly achieve good average camshaft wear (ACSW) and low levels of average tappet mass loss (ATWL) in the Cummins ISB Engine Lubricant Test of ASTM D7484-21b.

In approaches and embodiments herein, the lubricants include one or more base oils of lubricating viscosity and an antiwear system providing no more than about 500 ppm of phosphorus and/or no more than about 500 ppm of zinc from one or more overbased ZDDPs having hydrocarbyl groups bonded to a phosphorus atom through an oxygen linker. In embodiments, the antiwear system may have a zinc-to-phosphorus weight ratio (Zn:P) of 1.12 or less (i.e., 1.12:1 or less). It was also discovered that if the antiwear system had a certain average degree of branching of the hydrocarbyl groups and a minimum level of hydrocarbyl groups derived from secondary alcohols combined with the Zn:P ratios, then the lubricant containing the antiwear system provided the good tappet and camshaft wear performance even with the lower levels of phosphorus and/or zinc in the lubricant.

As also used herein, average degree of branching of the hydrocarbyl groups in the antiwear system is the number of carbons in the longest hydrocarbyl chain off the oxygen atom in the ZDDPs divided by the total number of carbons in that hydrocarbyl group and then adjusted for the ratio of each hydrocarbyl group in the antiwear system. For instance, if methyl isobutyl carbinol (MIBC) was used to produce a ZDDP in the antiwear system, then hydrocarbyl groups derived from this alcohol would have a degree of branching of 0.67 because MIBC has 6 total carbons with the longest chain off the oxygen atom in the ZDDP being 4 carbons (i.e., the degree of branching is 4/6 or 0.67). The average degree of branching for the whole antiwear system is then adjusted for the hydrocarbyl groups on each of the compounds in the system. As an example, if the antiwear system included 50 percent of hydrocarbyl groups derived from MIBC (with a degree of branching of 0.67) and 50 percent of hydrocarbyl groups having a degree of branching of 1.0 (meaning a linear hydrocarbyl group), then the complete antiwear system would have an average degree of branching of 0.83 (i.e., (50%)(0.67)+(50%)(1.0)). As discussed more below, the antiwear systems herein have an average degree of branching of no more than about 0.72, and preferably, about 0.5 to about 0.7.

Metal Dihydrocarbyl Dithiophosphate Compounds

The medium and/or heavy duty crankcase lubricants herein include an antiwear system having one or more overbased metal dihydrocarbyl dithiophosphate compounds, and preferably, one or more overbased zinc dihydrocarbyl dithiophosphate compounds (ZDDPs). In one approach, the one or more overbased metal dihydrocarbyl dithiophosphate compounds of the antiwear systems herein provide no more than 500 ppm of phosphorus to the lubricant, and preferably, no more than about 350 ppm phosphorus to the lubricant. In other approaches, the one or more overbased metal dihydrocarbyl dithiophosphate compounds herein provide about 200 ppm to about 500 ppm phosphorus, or about 250 ppm to about 450 ppm phosphorus, or about 300 ppm to about 400 ppm phosphorus, or about 300 to about 320 ppm phosphorus. In yet other approaches, the one or more overbased metal dihydrocarbyl dithiophosphate compounds of the antiwear system herein are preferably overbased zinc dihydrocarbyl dithiophosphate compounds and provide no more than 500 ppm of zinc to the lubricant, and preferably, no more than about 350 ppm zinc to the lubricant. In other approaches, the one or more overbased zinc dihydrocarbyl dithiophosphate compounds herein provide about 200 ppm to about 500 ppm zinc, or about 250 ppm to about 450 ppm zinc, or about 300 ppm to about 400 ppm zinc, or about 320 to about 350 ppm zinc.

As noted above, the ZDDPs suitable for the medium and/or heavy duty diesel applications herein are overbased, and in embodiments herein, the overbased antiwear system has a zinc-to-phosphorus weight ratio (Zn:P) of 1.12 or less (i.e., 1.12:1 or less) and, in some approaches, about 1.0 to about 1.12, and in other approaches, about 1.0 to about 1.11, or in yet further approaches, about 1.05 to about 1.11.

The overbased metal dihydrocarbyl dithiophosphate compounds of the antiwear systems herein also have a specific average degree of branching. In approaches or embodiments, the antiwear system has an average degree of branching (as defined above) of no more than about 0.72, in other approaches or embodiments, no more than about 0.7, and in yet other approaches or embodiments, about 0.2 to about 0.72 or about 0.5 to about 0.7. As noted above, this average degree of branching is based on the total hydrocarbyl groups of all compounds in the antiwear system.

The hydrocarbyl groups on the antiwear systems herein may also have a certain average chain length and, in some embodiments, the average chain length may be 5 to 7 total carbons of the hydrocarbyl groups. As used herein, average chain length of the hydrocarbyl groups in the antiwear systems herein refers to the total number of carbons derived from the alcohol group(s) used to form the metal dihydrocarbyl dithiophosphate and then adjusted for the ratio of various hydrocarbyl groups of the antiwear system. For instance, a hydrocarbyl group derived from MIBC would have an average change length of 6 total carbons, a hydrocarbyl group derived from isopropanol would have an average change length of 3 total carbons, and so forth.

Suitable overbased metal dihydrocarbyl dithiophosphates compounds may include between 5 to about 10 weight percent metal (such as, about 6 to about 10 weight percent metal), and about 10 to about 20 weight percent sulfur, (such as about 13 to about 20 weight percent sulfur, or about 14 to about 19 weight percent sulfur). Suitable overbased metal dihydrocarbyl dithiophosphate compounds may comprise dihydrocarbyl dithiophosphate metal salts wherein the metal may be an alkali metal, alkaline earth metal, aluminum, lead, tin, molybdenum, manganese, nickel, copper, titanium, zirconium, zinc, or combinations thereof. Preferably, the metal is zinc.

The alkyl groups on the one or more overbased metal dihydrocarbyl dithiophosphate compounds of the antiwear system herein may be derived from primary alcohols, secondary alcohols, phenols, and/or mixtures thereof so long as the noted relationships of the average degree of branching and average chain length for the antiwear system as noted above are satisfied. For example, primary alcohol may include, but are not limited to, isobutyl alcohol, amyl alcohol, or 2-ethylhexyl alcohol, and the like. Secondary alcohols may include, but are not limited to methyl isobutyl carbinol, isopropanol, and the like. In some embodiments, the antiwear system includes at least about 50 weight percent of hydrocarbyl groups derived from secondary alcohols, or more preferably, at least about 65 weight percent of the hydrocarbyl groups derived from the secondary alcohols. In yet other embodiments, the antiwear system includes about 50 weight percent to about 75 weight percent of hydrocarbyl groups derived from secondary alcohols, and more preferably about 65 weight percent to about 70 weight percent of hydrocarbyl groups derived from the secondary alcohols.

The one or more overbased metal dihydrocarbyl dithiophosphate compounds in the antiwear system are not particularly limited so long as the whole antiwear system meets the phosphorus, zinc, degree of branching, average chain length, and/or Zn:P ratio parameters noted above to achieve the good valve train wear performance with the lower levels of phosphorus and/or zinc in the lubricants. Subject to the criteria noted above, examples of suitable overbased metal dihydrocarbyl dithiophosphate compounds may include, but are not limited to: zinc O,O-di($C_{8-14}$-alkyl)dithiophosphate; zinc O,O-bis(2-ethylhexyl) dithiophosphate; zinc O,O-diisooctyl dithiophosphate; zinc O,O-bis(dodecylphenyl) dithiophosphate; zinc O,O-diisodecyl dithiophosphate; zinc O,O-bis(6-methylheptyl) dithiophosphate; zinc O,O-dioctyl dithiophosphate; zinc O,O-dipentyl dithiophosphate; zinc O-(2-methylbutyl)-O-(2-methylpropyl)dithiophosphate; and zinc O-(3-methylbutyl)-O-(2-methylpropyl) dithiophosphate; zinc O,O-bis(4-methyl-2-pentyl) dithiophosphate; or combinations thereof.

In approaches or embodiments, the overbased metal dihydrocarbyl dithiophosphate compound suitable for antiwear systems herein may also have a structure of Formula I:

(Formula I)

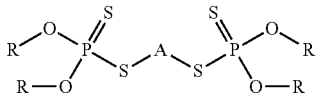

wherein each R in Formula I, independently, contains from 3 to 18 carbon atoms, or 3 to 12 carbon atoms, or about 3 to 10 carbon atoms so long as each phosphorus atom has, on average, at least 10 total carbons, and preferably at least 12 total carbons or 10 to 12 carbons. For example, each R may, independently, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl, methyl-pentyl, and/or 4-methyl-2-pentyl, or combinations thereof. The number of carbon atoms in each R group in the formula above will generally be about 3 or greater, about 4 or greater, about 6 or greater, or about 8 or greater. In Formula I, A is a metal, such as aluminum, lead, tin, molybdenum, manganese, nickel, copper, titanium, zirconium, zinc, or combinations thereof and, preferably, A is zinc. When the overbased metal dihydrocarbyl dithiophosphate compound has the structure shown in Formula I and with A being zinc, the compound may have about 4 to about 9 weight percent phosphorus and about 6 to about 10 weight percent zinc.

In some approaches or embodiments, it is understood in the art that a more accurate representation of the sulfur-zinc coordination arrangement may be represented by the symmetrical arrangement shown below with the chemical structure of Formula II that may be used herein as interchangeable with Formula I shown above. It is also understood that the structures shown in Formulas I and II may be present as monomer, dimer, trimer, or oligomer (such as a tetramer).

(Formula II)

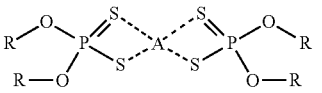

Overbased dihydrocarbyl dithiophosphate metal salts may be prepared in accordance with known techniques by first forming a dihydrocarbyl dithiophosphoric acid (DDPA), usually by reaction of one or more alcohols or phenols with $P_2S_5$ and then neutralizing the formed DDPA with a metal compound, such as zinc oxide. For example, DDPA may be made by reacting mixtures of alcohols including the suitable amounts of primary alcohols and/or secondary alcohols with $P_2S_5$. In one embodiment, the DDPA includes alkyl groups predominately derived from secondary alcohols or both primary and secondary alcohols as needed to meet the required average degree of branching of the metal dihydrocarbyl dithiophosphate compounds in the antiwear system. Alternatively, multiple DDPAs can be prepared where the alkyl groups on one DDPA are derived entirely from secondary alcohols and the alkyl groups on another DDPA are derived entirely from primary alcohols. The DDPAs are then blended together to form a mixture of DDPAs having alkyl groups meeting the average degree of branching of the metal dihydrocarbyl dithiophosphate compounds in the antiwear system.

Base Oil or Base Oil Blend

The base oil used in the medium and/or heavy duty crankcase lubricants herein may be one or more oils of lubricating viscosity and selected from any of the base oils in API Groups I to V as specified in the American Petroleum Institute (API) Base Oil Interchangeability Guidelines as suitable for use in medium and heavy duty diesel applications. The five base oil groups are generally set forth in Table 1 below:

TABLE 1

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks. Group IV base oils contain true synthetic molecular species, which are produced by polymerization of olefinic unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry. Group II+ may comprise high viscosity index Group II.

The base oil blend used in the disclosed lubricating oil composition may be a mineral oil, animal oil, vegetable oil, synthetic oil, synthetic oil blends, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example, such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propylene-isobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The major amount of base oil included in a lubricating composition may be selected from the group consisting of Group I, Group II, a Group III, a Group IV, a Group V, and a combination of two or more of the foregoing, and wherein the major amount of base oil is other than base oils that arise from provision of additive components or viscosity index improvers in the composition. In another embodiment, the major amount of base oil included in a lubricating composition may be selected from the group consisting of Group II, a Group III, a Group IV, a Group V, and a combination of two or more of the foregoing, and wherein the major amount of base oil is other than base oils that arise from provision of additive components or viscosity index improvers in the composition.

The amount of the oil of lubricating viscosity present may be the balance remaining after subtracting from 100 wt % the sum of the amount of the performance additives inclusive of viscosity index improver(s) and/or pour point depressant(s) and/or other top treat additives. For example, the oil of lubricating viscosity that may be present in a finished fluid may be a major amount, such as greater than about 50 wt %, greater than about 60 wt %, greater than about 70 wt %, greater than about 80 wt %, greater than about 85 wt %, or greater than about 90 wt %.

The base oil systems herein, in some approaches or embodiments, include one or more of a Group I to Group V base oils and the lubricating compositions herein may have a KV100 (ASTM D445) of about 2 to about 20 cSt, in other approaches, about 2 to about 15 cSt, about 3 to about 12 cSt, in yet other approaches, about 4 to about 12 cSt, and in other approaches about 4 to about 7 cSt.

Optional Additives

The lubricating oil compositions herein may also include a number of optional additives to meet performance standards for medium and heavy duty diesel applications. Those optional additives are described in the following paragraphs.

Dispersants

The lubricating oil composition may optionally include one or more dispersants or mixtures thereof. Dispersants are often known as ashless-type dispersants because, prior to mixing in a lubricating oil composition, they do not contain ash-forming metals and they do not normally contribute any ash when added to a lubricant. Ashless-type dispersants are characterized by a polar group attached to a relatively high molecular weight hydrocarbon chain. Typical ashless dispersants include N-substituted long chain alkenyl succinimides. Examples of N-substituted long chain alkenyl succinimides include polyisobutylene succinimides with the number average molecular weight of the polyisobutylene substituent being in the range about 350 to about 5,000, or to about 3,000, as measured by GPC. Succinimide dispersants and their preparation are disclosed, for instance in U.S. Pat. No. 7,897,696 or 4,234,435. The alkenyl substituent may be prepared from polymerizable monomers containing about 2 to about 16, or about 2 to about 8, or about 2 to about 6 carbon atoms. Succinimide dispersants are typically the imide formed from a polyamine, typically a poly(ethyleneamine).

Preferred amines are selected from polyamines and hydroxyamines. Examples of polyamines that may be used include, but are not limited to, diethylene triamine (DETA), triethylene tetramine (TETA), tetraethylene pentamine (TEPA), and higher homologues such as pentaethylene hexamine (PEHA), and the like.

A suitable heavy polyamine is a mixture of polyalkylenepolyamines comprising small amounts of lower polyamine oligomers such as TEPA and PEHA but primarily oligomers with 6 or more nitrogen atoms, 2 or more primary amines per molecule, and more extensive branching than conventional polyamine mixtures. A heavy polyamine preferably includes polyamine oligomers containing 7 or more nitrogens per molecule and with 2 or more primary amines per molecule. The heavy polyamine comprises more than 28 wt. % (e.g. >32 wt. %) total nitrogen and an equivalent weight of primary amine groups of 120-160 grams per equivalent.

In some approaches, suitable polyamines are commonly known as PAM contain a mixture of ethylene amines where TEPA and PEHA are the major part of the polyamine, usually less than about 80%.

Typically, PAM has 8.7-8.9 milliequivalents of primary amine per gram (an equivalent weight of 115 to 112 grams per equivalent of primary amine) and a total nitrogen content of about 33-34 wt. %. Heavier cuts of PAM oligomers with practically no TEPA and only very small amounts of PEHA but containing primarily oligomers with more than 6 nitrogens and more extensive branching, may produce dispersants with improved dispersancy.

In an embodiment the present disclosure further comprises at least one polyisobutylene succinimide dispersant derived from polyisobutylene with a number average molecular weight in the range about 350 to about 5,000, or to about 3,000, as determined by GPC. The polyisobutylene succinimide may be used alone or in combination with other dispersants.

In some embodiments, polyisobutylene, when included, may have greater than 50 mol %, greater than 60 mol %, greater than 70 mol %, greater than 80 mol %, or greater than 90 mol % content of terminal double bonds. Such PIB is also referred to as highly reactive PIB ("HR-PIB"). HR-PIB having a number average molecular weight ranging from about 800 to about 5,000, as determined by GPC, is suitable for use in embodiments of the present disclosure. Conventional PIB typically has less than 50 mol %, less than 40 mol %, less than 30 mol %, less than 20 mol %, or less than 10 mol % content of terminal double bonds.

An HR-PIB having a number average molecular weight ranging from about 900 to about 3,000 may be suitable, as determined by GPC. Such HR-PIB is commercially available, or can be synthesized by the polymerization of isobutene in the presence of a non-chlorinated catalyst such as boron trifluoride, as described in U.S. Pat. No. 4,152,499 to Boerzel, et al. and U.S. Pat. No. 5,739,355 to Gateau, et al. When used in the aforementioned thermal ene reaction, HR-PIB may lead to higher conversion rates in the reaction, as well as lower amounts of sediment formation, due to increased reactivity. A suitable method is described in U.S. Pat. No. 7,897,696.

In one embodiment, the present disclosure further comprises at least one dispersant derived from polyisobutylene succinic anhydride ("PIBSA"). The PIBSA may have an average of between about 1.0 and about 2.0 succinic acid moieties per polymer.

The % actives of the alkenyl or alkyl succinic anhydride can be determined using a chromatographic technique. This method is described in column 5 and 6 in U.S. Pat. No. 5,334,321.

The percent conversion of the polyolefin is calculated from the % actives using the equation in column 5 and 6 in U.S. Pat. No. 5,334,321.

In one embodiment, the dispersant may be derived from a polyalphaolefin (PAO) succinic anhydride. In one embodiment, the dispersant may be derived from olefin maleic anhydride copolymer. As an example, the dispersant may be described as a poly-PIBSA. In an embodiment, the dispersant may be derived from an anhydride which is grafted to an ethylene-propylene copolymer.

A suitable class of nitrogen-containing dispersants may be derived from olefin copolymers (OCP), more specifically, ethylene-propylene dispersants which may be grafted with maleic anhydride. A more complete list of nitrogen-containing compounds that can be reacted with the functionalized OCP are described in U.S. Pat. Nos. 7,485,603; 7,786,057; 7,253,231; 6,107,257; and 5,075,383; and/or are commercially available.

One class of suitable dispersants may also be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of dispersants may also be high molecular weight esters or half ester amides.

A suitable dispersant may also be post-treated by conventional methods by a reaction with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. Nos. 7,645,726; 7,214,649; and 8,048,831 are incorporated herein by reference in their entireties.

The boron compound used as a post-treating reagent can be selected from boron oxide, boron halides, boron acids and esters of boron acids in an amount to provide from about 0.1 atomic proportion of boron for each mole of the nitrogen composition to about 20 atomic proportions of boron for each atomic proportion of nitrogen used. The dispersant post-treated with boron may contain from about 0.05 weight percent to about 2.0 weight percent, or in other approaches, about 0.5 weight percent to about 1.0 weight percent boron, based on the total weight of the borated dispersant.

In other approaches, carboxylic acid may also be used as a post-treating reagent and can be saturated or unsaturated mono-, di-, or poly-carboxylic acid. Examples of carboxylic acids include, but are not limited to, maleic acid, fumaric acid, succinic acid, and naphthalic diacid (e.g., 1,8-naphthalic diacid). Anhydrides can also be used as a post-treating reagent and can be selected from the group consisting of mono-unsaturated anhydride (e.g., maleic anhydride), alkyl or alkylene-substituted cyclic anhydrides (e.g., succinic anhydride or glutamic anhydride), and aromatic carboxylic anhydrides (including naphthalic anhydride, e.g., 1,8-naphthalic anhydride).

In one embodiment, the process of post-treating the dispersant includes first forming the succinimide product, as described above, and then further reacting the succinimide product with the post treating agent, such as a boron compound, such as boric acid. In some cases, the dispersants herein may be post-treated with more than one post-treatment agents. For example, the dispersant may be post-treated with a boron compound, such as boric acid, and also an anhydride, such as maleic anhydride. In some cases, the dispersant may be post-treated with an anhydride such as maleic anhydride and/or 1,8-naphthalic anhydride.

In addition to the above post-treatments, the dispersants may be post-treated, or further post-treatment, with a variety of post-treatments designed to improve or impart different properties. Such post-treatments include those summarized in columns 27-29 of U.S. Pat. No. 5,241,003, hereby incorporated by reference. Such treatments include, treatment with: Inorganic phosphorous acids or anhydrates (e.g., U.S. Pat. Nos. 3,403,102 and 4,648,980); Organic phosphorous compounds (e.g., U.S. Pat. No. 3,502,677); Phosphorous pentasulfides; Boron compounds as already noted above (e.g., U.S. Pat. Nos. 3,178,663 and 4,652,387); Carboxylic acid, polycarboxylic acids, anhydrides and/or acid halides (e.g., U.S. Pat. Nos. 3,708,522 and 4,948,386); Epoxides polyepoxiates or thioexpoxides (e.g., U.S. Pat. Nos. 3,859,318 and 5,026,495); Aldehyde or ketone (e.g., U.S. Pat. No. 3,458,530); Carbon disulfide (e.g., U.S. Pat. No. 3,256,185); Glycidol (e.g., U.S. Pat. No. 4,617,137); Urea, thiourea or guanidine (e.g., U.S. Pat. Nos. 3,312,619; 3,865,813; and British Patent GB 1,065,595); Organic sulfonic acid (e.g., U.S. Pat. No. 3,189,544 and British Patent GB 2,140,811); Alkenyl cyanide (e.g., U.S. Pat. Nos. 3,278,550 and 3,366,569); Diketene (e.g., U.S. Pat. No. 3,546,243); A diisocyanate (e.g., U.S. Pat. No. 3,573,205); Alkane sultone (e.g., U.S. Pat. No. 3,749,695); 1,3-Dicarbonyl Compound (e.g., U.S. Pat. No. 4,579,675); Sulfate of alkoxylated alcohol or phenol (e.g., U.S. Pat. No. 3,954,639); Cyclic lactone (e.g., U.S. Pat. Nos. 4,617,138; 4,645,515; 4,668,246; 4,963,275; and 4,971,711); Cyclic carbonate or thiocarbonate linear monocarbonate or polycarbonate, or chloroformate (e.g., U.S. Pat. Nos. 4,612,132; 4,647,390; 4,648,886; 4,670,170); Nitrogen-containing carboxylic acid (e.g., U.S. Pat. No. 4,971,598 and British Patent GB 2,140,811); Hydroxy-protected chlorodicarbonyloxy compound (e.g., U.S. Pat. No. 4,614,522); Lactam, thiolactam, thiolactone or dithiolactone (e.g., U.S. Pat. Nos. 4,614,603 and 4,666,460); Cyclic carbonate or thiocarbonate, linear monocarbonate or polycarbonate, or chloroformate (e.g., U.S. Pat. Nos. 4,612,132; 4,647,390; 4,646,860; and 4,670,170); Nitrogen-containing carboxylic acid (e.g., U.S. Pat. No. 4,971,598 and British Patent GB 2,440,811); Hydroxy-protected chlorodicarbonyloxy compound (e.g., U.S. Pat. No. 4,614,522); Lactam, thiolactam, thiolactone or dithiolactone (e.g., U.S.

Pat. Nos. 4,614,603, and 4,666,460); Cyclic carbamate, cyclic thiocarbamate or cyclic dithiocarbamate (e.g., U.S. Pat. Nos. 4,663,062 and 4,666,459); Hydroxyaliphatic carboxylic acid (e.g., U.S. Pat. Nos. 4,482,464; 4,521,318; 4,713,189); Oxidizing agent (e.g., U.S. Pat. No. 4,379,064); Combination of phosphorus pentasulfide and a polyalkylene polyamine (e.g., U.S. Pat. No. 3,185,647); Combination of carboxylic acid or an aldehyde or ketone and sulfur or sulfur chloride (e.g., U.S. Pat. Nos. 3,390,086; 3,470,098); Combination of a hydrazine and carbon disulfide (e.g. U.S. Pat. No. 3,519,564); Combination of an aldehyde and a phenol (e.g., U.S. Pat. Nos. 3,649,229; 5,030,249; 5,039,307); Combination of an aldehyde and an O-diester of dithiophosphoric acid (e.g., U.S. Pat. No. 3,865,740); Combination of a hydroxyaliphatic carboxylic acid and a boric acid (e.g., U.S. Pat. No. 4,554,086); Combination of a hydroxyaliphatic carboxylic acid, then formaldehyde and a phenol (e.g., U.S. Pat. No. 4,636,322); Combination of a hydroxyaliphatic carboxylic acid and then an aliphatic dicarboxylic acid (e.g., U.S. Pat. No. 4,663,064); Combination of formaldehyde and a phenol and then glycolic acid (e.g., U.S. Pat. No. 4,699,724); Combination of a hydroxyaliphatic carboxylic acid or oxalic acid and then a diisocyanate (e.g. U.S. Pat. No. 4,713,191); Combination of inorganic acid or anhydride of phosphorus or a partial or total sulfur analog thereof and a boron compound (e.g., U.S. Pat. No. 4,857,214); Combination of an organic diacid then an unsaturated fatty acid and then a nitrosoaromatic amine optionally followed by a boron compound and then a glycolating agent (e.g., U.S. Pat. No. 4,973,412); Combination of an aldehyde and a triazole (e.g., U.S. Pat. No. 4,963,278); Combination of an aldehyde and a triazole then a boron compound (e.g., U.S. Pat. No. 4,981,492); Combination of cyclic lactone and a boron compound (e.g., U.S. Pat. Nos. 4,963,275 and 4,971,711). The above-mentioned patents are herein incorporated in their entireties.

The TBN of a suitable dispersant may be from about 10 to about 60 mg KOH/g dispersant, on an oil-free basis, which is comparable to about 5 to about 30 TBN if measured on a dispersant sample containing about 50% diluent oil. TBN is measured by the method of ASTM D2896.

The dispersant, if present, can be used in an amount sufficient to provide up to about 15 wt %, based upon the final weight of the lubricating oil composition. Another amount of the dispersant that can be used may be about 5 wt % to about 10 wt %, or about 6 wt % to about 9 wt %, about 5 to 8 wt %, or about 6 wt % to about 8 wt %, or about 7 wt % to about 8 wt %, based upon the final weight of the lubricating oil composition. In some embodiments, the lubricating oil composition utilizes a mixed dispersant system. A single type or a mixture of two or more types of dispersants in any desired ratio may be used.

Antioxidants

The lubricating oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox® L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms.

Useful antioxidants may include alkylated diarylamines and sterically hindered phenols. In an embodiment, the lubricating oil composition may contain a mixture of an alkylated diarylamine and a sterically hindered phenol, such that each antioxidant may be present in an amount sufficient to provide up to about 5%, by weight, based upon the final weight of the lubricating oil composition. In an embodiment, the antioxidant may be a mixture of about 0.5 to about 1.5% alkylated diarylamine and about 0.5 to about 1.5% sterically hindered phenol, by weight, based upon the final weight of the lubricating oil composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as α-olefins.

In another alternative embodiment the antioxidant composition also contains a molybdenum-containing antioxidant in addition to the phenolic and/or aminic antioxidants discussed above.

The one or more antioxidant(s) may be present in ranges about 0.5 wt % to about 5 wt %, or about 1.0 wt % to about 4 wt %, or about 2 wt % to about 3 wt %, of the lubricating oil composition.

Other Antiwear Agents

The lubricating oil compositions herein also may optionally contain one or more additional antiwear agents. Examples of suitable additional antiwear agents include, but are not limited to a phosphoric acid ester or salt thereof; a phosphate ester(s); a phosphite; a phosphorus-containing carboxylic ester, ether, or amide; a sulfurized olefin; thiocarbamate-containing compounds including, thiocarbamate esters, alkylene-coupled thiocarbamates, and bis(S-alkyldithiocarbamyl)disulfides; and mixtures thereof. A suitable antiwear agent may be a molybdenum dithiocarbamate. The phosphorus containing antiwear agents are more fully described in European Patent 612 839. The metal in the dialkyl dithio phosphate salts may be an alkali metal, alkaline earth metal, aluminum, lead, tin, molybdenum, manganese, nickel, copper, titanium, or zinc. A useful antiwear agent may be zinc dialkyldithiophosphate.

Further examples of suitable antiwear agents include titanium compounds, tartrates, tartrimides, oil soluble amine salts of phosphorus compounds, sulfurized olefins, phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl)disulfides. The tartrate or tartrimide may contain alkyl-ester groups, where the sum of carbon atoms on the alkyl groups may be at least 8. The antiwear agent may in one embodiment include a citrate.

The additional antiwear agent may be present in ranges including about 0 wt % to about 15 wt %, or about 0.01 wt % to about 10 wt %, or about 0.05 wt % to about 5 wt %, or about 0.1 wt % to about 3 wt % of the lubricating oil composition.

Boron-Containing Compounds

The lubricating oil compositions herein may optionally contain one or more boron-containing compounds. Examples of boron-containing compounds include borate esters, borated fatty amines, borated epoxides, borated detergents, and borated dispersants, such as borated succinimide dispersants, as disclosed in U.S. Pat. No. 5,883,057. The boron-containing compound, if present, can be used in an amount sufficient to provide up to about 8 wt %, about 0.01 wt % to about 7 wt %, about 0.05 wt % to about 5 wt %, or about 0.1 wt % to about 3 wt % of the lubricating oil composition.

Detergents

The lubricating oil composition may optionally further comprise one or more neutral, low based, or overbased detergents, and mixtures thereof. Suitable detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds, or methylene bridged phenols. Suitable detergents and their methods of preparation are described in greater detail in numerous patent publications, including U.S. Pat. No. 7,732,390 and references cited therein. The lubricant compositions herein may include about 0.1 to about 5 weight percent of individual and/or total detergent additives, and in other approaches, about 0.15 to about 3 weight percent, and in yet other approaches, about 0.5 to 2.5 weight percent of individual and/or total detergent additives so long as the detergent additives meet the sulfonate amounts and other relationships noted herein.

Generally, suitable detergents in the system may include linear or branched alkali or alkaline earth metal salts, such as calcium, sodium, or magnesium, of petroleum sulfonic acids and long chain mono- or di-alkylaryl sulfonic acids with the aryl group being benzyl, tolyl, and xylyl and/or various phenates or derivatives of phenates. Examples of suitable detergents include low-based/neutral and overbased variations of the following detergents: calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

As understood, overbased detergent additives are well-known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The detergent substrate may be salted with an alkali or alkaline earth metal such as, but not limited to, calcium, magnesium, potassium, sodium, lithium, barium, or mixtures thereof. In some embodiments, a detergent may contain traces of other metals such as magnesium or calcium in amounts such as 50 ppm or less, 40 ppm or less, 30 ppm or less, 20 ppm or less, or 10 ppm or less. A suitable detergent may include alkali or alkaline earth metal salts of petroleum sulfonic acids and long chain mono- or di-alkylarylsulfonic acids with the aryl group being benzyl, tolyl, and xylyl. Examples of suitable detergents include, but are not limited to, calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

Overbased detergent additives are well known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The terminology "overbased" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, or phenols.

The overbased detergent may have a metal to substrate ratio of from 1.1:1, or from 2:1, or from 4:1, or from 5:1, or from 7:1, or from 10:1, or less, or from 12:1 or less, or from 15:1 or less, or from 20:1 or less.

As used herein, the term "TBN" is used to denote the Total Base Number in mg KOH/g as measured by the method of ASTM D2896. The detergents used herein may be neutral or overbased. For example, a low-base or neutral detergent may have a total base number (TBN) of up to about 175 mg KOH/gram. An overbased detergent of the lubricating oil composition may have a total base number (TBN) of about 200 mg KOH/g or greater, or as further examples, about 250 mg KOH/g or greater, or about 300 mg KOH/g or greater, or about 375 mg KOH/g or greater, or about 400 mg KOH/g or greater. The TBN being measured by the method of ASTM D2896.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols. In some embodiments, a detergent used in the lubricants herein include at least an overbased calcium sulfonate having a total base number of 200 to 400 and, in other approaches, about 250 to about 350. In some approaches, the lubricants include a blend of overbased calcium sulfonate and overbased calcium phenate detergent and the lubricants herein may include about 0.1 to about 2.0 weight percent of overbased calcium phenate detergent and about 0.1 to about 1.0 weight percent of overbased calcium sulfonate detergents (or in other approaches, about 0.5 to about 1.0 weight percent of overbased calcium sulfonate detergents). If present, the overbased calcium phenate detergents may have a total base number of at least about 150 mg KOH/g, at least about 225 mg KOH/g, at least about 225 mg KOH/g to about 400 mg KOH/g, at least about 225 mg KOH/g to about 350 mg KOH/g or about 230 mg KOH/g to about 350 mg KOH/g, all as measured by the method of ASTM D2896. When such detergent compositions are formed in an inert diluent, e.g. a process oil, usually a mineral oil, the total base number reflects the basicity of the overall composition including diluent, and any other materials (e.g., promoter, etc.) that may be contained in the detergent composition.

The total detergent content may be present in a lubricating composition at about 1.0 wt % to about 8 wt %, or about 1 wt % to about 4 wt %, or less than about 4 wt %.

Extreme Pressure Agents

The lubricating oil compositions herein also may optionally contain one or more extreme pressure agents. Extreme Pressure (EP) agents that are soluble in the oil include sulfur-containing EP agents and phosphorus EP agents. Examples of such EP agents include organic sulfides and polysulfides such as dibenzyldisulfide, dibutyl tetrasulfide, sulfurized methyl ester of oleic acid, sulfurized alkyl phenol, sulfurized dipentene, sulfurized terpene, dithiocarbamates, and sulfurized Diels-Alder adducts; phosphosulfurized hydrocarbons such as the reaction product of phosphorus sulfide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenyl phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

Friction Modifiers

The lubricating oil compositions herein also may optionally contain one or more friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms. In some embodiments the friction modifier may be a long chain fatty acid ester. In another embodiment the long chain fatty acid ester may be a mono-ester, or a di-ester, or a (tri)glyceride. The friction modifier may be a long chain fatty amide, a long chain fatty ester, a long chain fatty epoxide derivatives, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685, herein incorporated by reference in its entirety.

Aminic friction modifiers may include amines or polyamines. Such compounds can have hydrocarbyl groups that are linear, either saturated or unsaturated, or a mixture thereof and may contain from about 12 to about 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291, herein incorporated by reference in its entirety.

A friction modifier may optionally be present in ranges such as about 0 wt % to about 10 wt %, or about 0.01 wt % to about 8 wt %, or about 0.1 wt % to about 4 wt %.

Molybdenum-Containing Component

The lubricating oil compositions herein also may optionally contain one or more molybdenum-containing compounds. An oil-soluble molybdenum compound may have the functional performance of an antiwear agent, an antioxidant, a friction modifier, or mixtures thereof. An oil-soluble molybdenum compound may include molybdenum dithiocarbamates, molybdenum dialkyldithiophosphates, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organo-molybdenum compound, and/or mixtures thereof. The molybdenum sulfides include molybdenum disulfide. The molybdenum disulfide may be in the form of a stable dispersion. In one embodiment the oil-soluble molybdenum compound may be selected from the group consisting of molybdenum dithiocarbamates, molybdenum dialkyldithiophosphates, amine salts of molybdenum compounds, and mixtures thereof. In one embodiment the oil-soluble molybdenum compound may be a molybdenum dithiocarbamate.

Suitable examples of molybdenum compounds which may be used include commercial materials sold under the trade names such as Molyvan® 822, Molyvan® A, Molyvan® 2000 and Molyvan® 855 from R. T. Vanderbilt Co., Ltd., and Adeka Sakura-Lube® S-165, S-200, S-300, S-310G, S-525, S-600, S-700, and S-710 available from Adeka Corporation, and mixtures thereof. Suitable molybdenum components are described in U.S. Pat. No. 5,650,381; US RE 37,363 E1; US RE 38,929 E1; and US RE 40,595 E1, incorporated herein by reference in their entireties.

Additionally, the molybdenum compound may be an acidic molybdenum compound. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897, incorporated herein by reference in their entireties.

Another class of suitable organo-molybdenum compounds are trinuclear molybdenum compounds, such as those of the formula $Mo_3S_kL_nQ_z$ and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, such as at least 25, at least 30, or at least 35 carbon atoms. Additional suitable molybdenum compounds are described in U.S. Pat. No. 6,723,685, herein incorporated by reference in its entirety.

The oil-soluble molybdenum compound may be present in an amount sufficient to provide about 0.5 ppm to about 2000 ppm, about 1 ppm to about 700 ppm, about 1 ppm to about 550 ppm, about 5 ppm to about 300 ppm, or about 20 ppm to about 250 ppm of molybdenum.

Transition Metal-Containing Compounds

In another embodiment, the oil-soluble compound may be a transition metal containing compound or a metalloid. The transition metals may include, but are not limited to, titanium, vanadium, copper, zinc, zirconium, molybdenum, tantalum, tungsten, and the like. Suitable metalloids include, but are not limited to, boron, silicon, antimony, tellurium, and the like.

In an embodiment, an oil-soluble transition metal-containing compound may function as antiwear agents, friction modifiers, antioxidants, deposit control additives, or more than one of these functions. In an embodiment the oil-soluble transition metal-containing compound may be an oil-soluble titanium compound, such as a titanium (IV) alkoxide. Among the titanium containing compounds that may be used in, or which may be used for preparation of the oils-soluble materials of, the disclosed technology are various Ti (IV) compounds such as titanium (IV) oxide; titanium (IV) sulfide; titanium (IV) nitrate; titanium (IV) alkoxides such as titanium methoxide, titanium ethoxide, titanium propoxide, titanium isopropoxide, titanium butoxide, titanium 2-ethylhexoxide; and other titanium compounds or complexes including but not limited to titanium phenates; titanium carboxylates such as titanium (IV) 2-ethyl-1-3-hexanedioate or titanium citrate or titanium oleate; and titanium (IV) (triethanolaminato)isopropoxide. Other forms of titanium encompassed within the disclosed technology include titanium phosphates such as titanium dithiophosphates (e.g., dialkyldithiophosphates) and titanium sulfonates (e.g., alkylbenzenesulfonates), or, generally, the reaction product of titanium compounds with various acid materials to form salts, such as oil-soluble salts. Titanium compounds can thus be derived from, among others, organic acids, alcohols, and glycols. Ti compounds may also exist in dimeric or oligomeric form, containing Ti—O—Ti structures. Such titanium materials are commercially available or can be readily prepared by appropriate synthesis techniques which will be apparent to the person skilled in the art. They may exist at room temperature as a solid or a liquid, depending on the particular compound. They may also be provided in a solution form in an appropriate inert solvent.

In one embodiment, the titanium can be supplied as a Ti-modified dispersant, such as a succinimide dispersant. Such materials may be prepared by forming a titanium mixed anhydride between a titanium alkoxide and a hydrocarbyl-substituted succinic anhydride, such as an alkenyl- (or alkyl) succinic anhydride. The resulting titanate-succinate intermediate may be used directly or it may be reacted with any of a number of materials, such as (a) a polyamine-based succinimide/amide dispersant having free, condensable —NH functionality; (b) the components of a polyamine-based succinimide/amide dispersant, i.e., an alkenyl- (or alkyl-) succinic anhydride and a polyamine, (c) a hydroxy-containing polyester dispersant prepared by the reaction of a substituted succinic anhydride with a polyol, aminoalcohol, polyamine, or mixtures thereof. Alternatively, the titanate-succinate intermediate may be reacted with other agents such as alcohols, aminoalcohols, ether alcohols, polyether alcohols or polyols, or fatty acids, and the product thereof either used directly to impart Ti to a lubricant, or else further reacted with the succinic dispersants as described above. As an example, 1 part (by mole) of tetraisopropyl titanate may be reacted with about 2 parts (by mole) of a polyisobutene-substituted succinic anhydride at 140-150° C. for 5 to 6 hours to provide a titanium modified dispersant or intermediate. The resulting material (30 g) may be further reacted with a succinimide dispersant from polyisobutene-substituted succinic anhydride and a polyethylenepolyamine mixture (127 grams+diluent oil) at 150° C. for 1.5 hours, to produce a titanium-modified succinimide dispersant.

Another titanium containing compound may be a reaction product of titanium alkoxide and $C_6$ to $C_{25}$ carboxylic acid. The reaction product may be represented by the following formula:

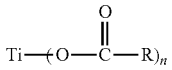

wherein n is an integer selected from 2, 3 and 4, and R is a hydrocarbyl group containing from about 5 to about 24 carbon atoms, or by the formula:

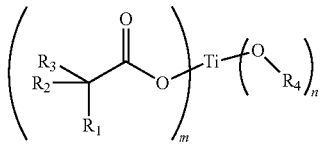

wherein m+n=4 and n ranges from 1 to 3, $R_4$ is an alkyl moiety with carbon atoms ranging from 1-8, $R_1$ is selected from a hydrocarbyl group containing from about 6 to 25 carbon atoms, and $R_2$ and $R_3$ are the same or different and are selected from a hydrocarbyl group containing from about 1 to 6 carbon atoms, or the titanium compound may be represented by the formula:

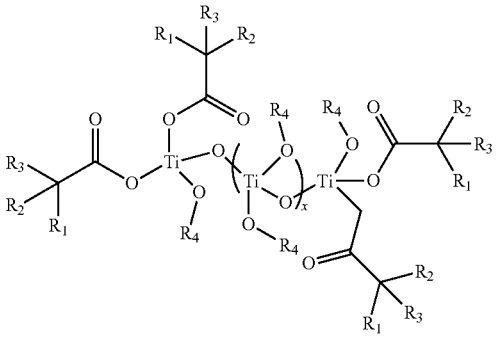

wherein x ranges from 0 to 3, $R_1$ is selected from a hydrocarbyl group containing from about 6 to 25 carbon atoms, $R_2$, and $R_3$ are the same or different and are selected from a hydrocarbyl group containing from about 1 to 6 carbon atoms, and $R_4$ is selected from a group consisting of either H, or $C_6$ to $C_{25}$ carboxylic acid moiety.

Suitable carboxylic acids may include, but are not limited to caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic acid, neodecanoic acid, and the like.

In an embodiment the oil soluble titanium compound may be present in the lubricating oil composition in an amount to provide from 0 to 3000 ppm titanium by weight or 25 to about 1500 ppm titanium by weight or about 35 ppm to 500 ppm titanium by weight or about 50 ppm to about 300 ppm.

Viscosity Index Improvers

The lubricating oil compositions herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 20120101017A1.

The lubricating oil compositions herein also may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt % to about 20 wt %, about 0.1 wt % to about 15 wt %, about 0.1 wt % to about 12 wt %, or about 0.5 wt % to about 10 wt %, of the lubricating oil composition.

Other Optional Additives

Other additives may be selected to perform one or more functions required of a lubricating fluid. Further, one or more of the mentioned additives may be multi-functional and provide functions in addition to or other than the function prescribed herein.

A lubricating oil composition according to the present disclosure may optionally comprise other performance additives. The other performance additives may be in addition to specified additives of the present disclosure and/or may comprise one or more of metal deactivators, viscosity index improvers, detergents, ashless TBN boosters, friction modifiers, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these performance additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include polymethylmethacrylates or mixtures thereof. Pour point depressants may be present in an amount sufficient to provide from about 0 wt % to about 1 wt %, about 0.01 wt % to about 0.5 wt %, or about 0.02 wt % to about 0.04 wt % based upon the final weight of the lubricating oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid.

The rust inhibitor, if present, can be used in an amount sufficient to provide about 0 wt % to about 5 wt %, about 0.01 wt % to about 3 wt %, about 0.1 wt % to about 2 wt %, based upon the final weight of the lubricating oil composition.

In general terms, a suitable lubricant including the antiwear systems herein may include additive components in the ranges listed in the following table.

TABLE 2

Suitable Lubricating Compositions

| Component | Wt. % (Suitable Embodiments) | Wt. % (Preferred Embodiments) |
|---|---|---|
| Antiwear system including one or more overbased metal dihydrocarbyl dithiophosphate compounds | 0.1-3.0 | 0.2-1.0 |
| Detergents | 1.0-5.0 | 1.5-3.5 |
| Succinimide Dispersant(s) | 2.0-6.0 | 3.0-5.0 |
| Antioxidant(s) | 1.0-5.0 | 1.5-3.0 |
| Extreme Pressure Agent(s) | 0-1.0 | 0-0.5 |
| Antifoaming agent(s) | 0.0-0.5 | 0.001-0.1 |
| Pour point depressant(s) | 0.0-1.0 | 0.01-0.5 |
| Viscosity index improver(s) | 0.0-10.0 | 0.0-9.0 |
| Dispersant viscosity index improver(s) | 0.0-3.0 | 0.0-2.0 |
| Friction modifier(s) | 0.0-1.0 | 0.0-0.5 |
| Base oil | Balance | Balance |
| Total | 100 | 100 |

The percentages of each component above represent the weight percent of each component, based upon the weight of the final lubricating oil composition. The remainder of the lubricating oil composition consists of one or more base oils. Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent). Fully formulated lubricants conventionally contain an additive package, referred to herein as a dispersant/inhibitor package or DI package, that will supply the characteristics that are required in the formulation.

Definitions

For purposes of this disclosure, the chemical elements are identified in accordance with the Periodic Table of the Elements, CAS version, Handbook of Chemistry and Physics, 75$^{th}$ Ed. Additionally, general principles of organic chemistry are described in "Organic Chemistry", Thomas Sorrell, University Science Books, Sausolito: 1999, and "March's Advanced Organic Chemistry", 5$^{th}$ Ed., Ed.: Smith, M. B. and March, J., John Wiley & Sons, New York: 2001, the entire contents of which are hereby incorporated by reference.

As described herein, compounds may optionally be substituted with one or more substituents, such as are illustrated generally above, or as exemplified by particular classes, subclasses, and species of the disclosure.

Unless otherwise apparent from the context, the term "major amount" is understood to mean an amount greater than or equal to 50 weight percent, for example, from about 80 to about 98 weight percent relative to the total weight of the composition. Moreover, as used herein, the term "minor amount" is understood to mean an amount less than 50 weight percent relative to the total weight of the composition.

As used herein, the term "hydrocarbyl group" or "hydrocarbyl" is used in its ordinary sense, which is well-known to those skilled in the art. Specifically, it refers to a group having a carbon atom directly attached to the remainder of a molecule and having a predominantly hydrocarbon character. Examples of hydrocarbyl groups include: (1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical); (2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, amino, alkylamino, and sulfoxy); (3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

As used herein the term "aliphatic" encompasses the terms alkyl, alkenyl, alkynyl, each of which being optionally substituted as set forth below.

As used herein, an "alkyl" group refers to a saturated aliphatic hydrocarbon group containing 1-12 (e.g., 1-8, 1-6, or 1-4) carbon atoms. An alkyl group can be straight or branched. Examples of alkyl groups include, but are not limited to, methyl, ethyl, propyl, isopropyl, butyl, isobutyl, sec-butyl, tert-butyl, n-pentyl, n-heptyl, or 2-ethylhexyl. An alkyl group can be substituted (i.e., optionally substituted) with one or more substituents such as halo, 33damantl, cycloaliphatic [e.g., cycloalkyl or cycloalkenyl], heterocycloaliphatic [e.g., heterocycloalkyl or heterocycloalkenyl], aryl, heteroaryl, alkoxy, aroyl, heteroaroyl, acyl [e.g., (aliphatic)carbonyl, (cycloaliphatic) carbonyl, or (heterocycloaliphatic)carbonyl], nitro, cyano, amido [e.g., (cycloalkylalkyl)carbonylamino, arylcarbonylamino, aralkylcarbonylamino, (heterocycloalkyl)carbonylamino, (heterocycloalkylalkyl) carbonylamino, heteroarylcarbonylamino, heteroaralkyl carbonylamino alkylaminocarbonyl, cycloalkylaminocarbonyl, heterocycloalkylaminocarbonyl, arylaminocarbonyl, or heteroarylaminocarbonyl], amino [e.g., aliphaticamino, cycloaliphatic amino, or heterocycloaliphaticamino], sulfonyl [e.g., aliphatic-$SO_2$—], sulfinyl, sulfanyl, sulfoxy, urea, thiourea, sulfamoyl, sulfamide, oxo, carboxy, carbamoyl, cycloaliphaticoxy, heterocyclo aliphaticoxy, aryloxy, heteroaryloxy, aralkyloxy, heteroarylalkoxy, alkoxycarbonyl, alkyl carbonyloxy, or hydroxy. Without limitation, some examples of substituted alkyls include carboxyalkyl (such as HOOC-alkyl, alkoxycarbonylalkyl, and alkylcarbonyloxyalkyl), cyanoalkyl, hydroxyalkyl, alkoxyalkyl, acylalkyl, aralkyl, (alkoxyaryl)alkyl, (sulfonylamino) alkyl (such as (alkyl-$SO_2$-amino)alkyl), aminoalkyl, amidoalkyl, (cycloaliphatic)alkyl, or haloalkyl.

As used herein, an "alkenyl" group refers to an aliphatic carbon group that contains 2-8 (e.g., 2-12, 2-6, or 2-4) carbon atoms and at least one double bond. Like an alkyl group, an alkenyl group can be straight or branched. Examples of an alkenyl group include, but are not limited to allyl, isoprenyl, 2-butenyl, and 2-hexenyl. An alkenyl group can be optionally substituted with one or more substituents such as halo, 34damantl, cycloaliphatic [e.g., cycloalkyl or cycloalkenyl], heterocycloaliphatic [e.g., heterocycloalkyl or hetero cycloalkenyl], aryl, heteroaryl, alkoxy, aroyl, heteroaroyl, acyl [e.g., (aliphatic) carbonyl, (cycloaliphatic) carbonyl, or (heterocycloaliphatic)carbonyl], nitro, cyano, amido [e.g., (cycloalkylalkyl)carbonylamino, arylcarbonylamino, aralkylcarbonylamino, (hetero cycloalkyl)carbonylamino, (heterocyclo alkylalkyl) carbonylamino, heteroaryl carbonylamino, heteroaralkylcarbonylamino alkylamino carbonyl, cycloalkylaminocarbonyl, hetero cyclo alkylaminocarbonyl, arylaminocarbonyl, or heteroarylaminocarbonyl], amino [e.g., aliphaticamino, cycloaliphaticamino, heterocyclo aliphaticamino, or aliphatic sulfonylamino], sulfonyl [e.g., alkyl-$SO_2$—, cycloaliphatic-$SO_2$—, or aryl-$SO_2$—], sulfinyl, sulfanyl, sulfoxy, urea, thiourea, sulfamoyl, sulfamide, oxo, carboxy, carbamoyl, cycloaliphaticoxy, heterocycloaliphaticoxy, aryloxy, heteroaryloxy, aralkyloxy, heteroaralkoxy, alkoxycarbonyl, alkylcarbonyloxy, or hydroxy. Without limitation, some examples of substituted alkenyls include cyanoalkenyl, alkoxyalkenyl, acylalkenyl, hydroxyl alkenyl, aralkenyl, (alkoxyaryl) alkenyl, (sulfonylamino)alkenyl (such as (alkyl-$SO_2$-amino) alkenyl), aminoalkenyl, amidoalkenyl, (cycloaliphatic)alkenyl, or haloalkenyl.

As used herein, an "alkynyl" group refers to an aliphatic carbon group that contains 2-8 (e.g., 2-12, 2-6, or 2-4) carbon atoms and has at least one triple bond. An alkynyl group can be straight or branched. Examples of an alkynyl group include, but are not limited to, propargyl and butynyl. An alkynyl group can be optionally substituted with one or more substituents such as aroyl, heteroaroyl, alkoxy, cycloalkyloxy, heterocycloalkyloxy, aryloxy, heteroaryloxy, aralkyl oxy, nitro, carboxy, cyano, halo, hydroxy, sulfo, mercapto, sulfanyl [e.g., aliphaticsulfanyl or cycloaliphaticsulfanyl], sulfinyl [e.g., aliphaticsulfinyl or cycloaliphaticsulfinyl], sulfonyl [e.g., aliphatic-$SO_2$—, aliphaticamino-$SO_2$—, or cycloaliphatic-$SO_2$—], amido [e.g., aminocarbonyl, alkylaminocarbonyl, alkylcarbonylamino, cyclo alkylaminocarbonyl, heterocycloalkylaminocarbonyl, cycloalkylcarbonylamino, arylamino carbonyl, arylcarbonylamino, aralkylcarbonylamino, (heterocycloalkyl) carbonylamino, (cycloalkylalkyl) carbonylamino, heteroaralkylcarbonylamino, heteroaryl carbonylamino or heteroaryl amino carbonyl], urea, thiourea, sulfamoyl, sulfamide, alkoxycarbonyl, alkyl carbonyloxy, cyclo aliphatic, heterocycloaliphatic, aryl, heteroaryl, acyl [e.g., (cycloaliphatic) carbonyl or (hetero cyclo aliphatic)carbonyl], amino [e.g., aliphaticamino], sulfoxy, oxo, carboxy, carbamoyl, (cycloaliphatic)oxy, (heterocyclo aliphatic)oxy, or (heteroaryl)alkoxy.

As used herein, an "amino" group refers to —$NR^XR^Y$ wherein each of $R^X$ and $R^Y$ is independently hydrogen, alkyl, cycloakyl, (cycloalkyl)alkyl, aryl, aralkyl, heterocycloalkyl, (heterocycloalkyl)alkyl, heteroaryl, carboxy, sulfanyl, sulfinyl, sulfonyl, (alkyl)carbonyl, (cycloalkyl)carbonyl, ((cycloalkyl)alkyl)carbonyl, arylcarbonyl, (aralkyl)carbonyl, (heterocyclo alkyl) carbonyl, ((heterocycloalkyl)alkyl)carbonyl, (heteroaryl)carbonyl, or (heteroaralkyl) carbonyl, each of which being defined herein and being optionally substituted. Examples of amino groups include alkylamino, dialkylamino, or arylamino. When the term "amino" is not the terminal group (e.g., alkylcarbonylamino), it is represented by —$NR^X$—. $R^X$ has the same meaning as defined above.

As used herein, a "cycloalkyl" group refers to a saturated carbocyclic mono- or bicyclic (fused or bridged) ring of 3-10 (e.g., 5-10) carbon atoms. Examples of cycloalkyl groups include cyclopropyl, cyclobutyl, cyclopentyl, cyclohexyl, cycloheptyl, adamantyl, norbornyl, cubyl, octahydroindenyl, decahydro-naphthyl, bicyclo[3.2.1]octyl, bicyclo [2.2.2] octyl, bicyclo[3.3.1]nonyl, bicyclo[3.3.2.]decyl, bicyclo[2.2.2]octyl, adamantyl, or ((aminocarbonyl)cycloalkyl)cycloalkyl.

As used herein, a "heterocycloalkyl" group refers to a 3-10 membered mono- or bicylic (fused or bridged) (e.g., 5- to 10-membered mono- or bicyclic) saturated ring structure, in which one or more of the ring atoms is a heteroatom (e.g., N, O, S, or combinations thereof). Examples of a heterocycloalkyl group include piperidyl, piperazyl, tetrahydropyranyl, tetrahydrofuryl, 1,4-dioxolanyl, 1,4-dithianyl, 1,3-dioxolanyl, oxazolidyl, isoxazolidyl, morpholinyl, thiomorpholyl, octahydrobenzofuryl, octahydrochromenyl, octahydrothio chromenyl, octahydroindolyl, octahydropyrindinyl, decahydroquinolinyl, octahydrobenzo[b] thiopheneyl, 2-oxa-bicyclo[2.2.2]octyl, 1-aza-bicyclo[2.2.2]octyl, 3-aza-bicyclo[3.2.1]octyl, and 2,6-dioxa-tricyclo [3.3.1.0]nonyl. A monocyclic heterocycloalkyl group can be fused with a phenyl moiety to form structures, such as tetrahydroisoquinoline, which would be categorized as heteroaryls.

A "heteroaryl" group, as used herein, refers to a monocyclic, bicyclic, or tricyclic ring system having 4 to 15 ring atoms wherein one or more of the ring atoms is a heteroatom (e.g., N, O, S, or combinations thereof) and in which the monocyclic ring system is aromatic or at least one of the rings in the bicyclic or tricyclic ring systems is aromatic. A heteroaryl group includes a benzofused ring system having 2 to 3 rings. For example, a benzofused group includes benzo fused with one or two 4 to 8 membered heterocycloaliphatic moieties (e.g., indolizyl, indolyl, isoindolyl, 3H-indolyl, indolinyl, benzo[b]furyl, benzo[b]thiophenyl, quinolinyl, or isoquinolinyl). Some examples of heteroaryl are pyridyl, 1H-indazolyl, furyl, pyrrolyl, thienyl, thiazolyl, oxazolyl, imidazolyl, tetrazolyl, benzofuryl, isoquinolinyl, benzthiazolyl, xanthene, thioxanthene, phenothiazine, dihydroindole, benzo[1,3]dioxole, benzo[b]furyl, benzo[b]thiophenyl, indazolyl, benzimidazolyl, benzthiazolyl, puryl, cinnolyl, quinolyl, quinazolyl, cinnolyl, phthalazyl, quinazolyl, quinoxalyl, isoquinolyl, 4H-quinolizyl, benzo-1,2,5-thiadiazolyl, or 1,8-naphthyridyl.

Without limitation, monocyclic heteroaryls include furyl, thiophenyl, 2H-pyrrolyl, pyrrolyl, oxazolyl, thazolyl, imidazolyl, pyrazolyl, isoxazolyl, isothiazolyl, 1,3,4-thiadiazolyl, 2H-pyranyl, 4-H-pranyl, pyridyl, pyridazyl, pyrimidyl, pyrazolyl, pyrazyl, or 1,3,5-triazyl. Monocyclic heteroaryls are numbered according to standard chemical nomenclature.

Without limitation, bicyclic heteroaryls include indolizyl, indolyl, isoindolyl, 3H-indolyl, indolinyl, benzo[b]furyl, benzo[b]thiophenyl, quinolinyl, isoquinolinyl, indolizinyl, isoindolyl, indolyl, benzo[b]furyl, bexo[b]thiophenyl, indazolyl, benzimidazyl, benzthiazolyl, purinyl, 4H-quinolizyl, quinolyl, isoquinolyl, cinnolyl, phthalazyl, quinazolyl, quinoxalyl, 1,8-naphthyridyl, or pteridyl. Bicyclic heteroaryls are numbered according to standard chemical nomenclature.

As used herein, the term "treat rate" refers to the weight percent of a component in the lubricating fluids.

The weight average molecular weight (Mw) or the number average molecular weight (Mn) may be determined with a gel permeation chromatography (GPC) instrument obtained from Waters or the like instrument and the data processed with Waters Empower Software or the like software. See, for example, W. W. Yau, J. J. Kirkland and D. D. Bly, "Modern Size Exclusion Liquid Chromatography", John Wiley and Sons, New York, 1979, also incorporated herein by reference. Herein, all molecular weights are number average molecular weights determined by gel permeation chromatography (GPC) using commercially available polystyrene standards (with a number average molecular weight of 180 to about 18,000 as the calibration reference). GPC measurements are also described in U.S. Pat. No. 5,266,223, which is incorporated herein by reference.

As used herein, the terms "oil composition," "lubrication composition," "lubricating oil composition," "lubricating oil," "lubricant composition," "fully formulated lubricant composition," "lubricant," and "lubricating and cooling fluid" are considered synonymous, fully interchangeable terminology referring to the finished lubrication product comprising a major amount of a base oil component plus minor amounts of the detergents and the other optional components.

Examples

A better understanding of the present disclosure and its many advantages may be clarified with the following examples. The following examples are illustrative and not limiting thereof in either scope or spirit. Those skilled in the art will readily understand that variations of the components, methods, steps, and devices described in these examples can be used. Unless noted otherwise or apparent from the context of discussion in the Examples below and throughout this disclosure, all percentages, ratios, and parts noted in this disclosure are by weight.

Inventive and Comparative Antiwear systems for lubricants suitable for medium and/or heavy duty diesel engines were evaluated for valve train wear pursuant to the Cummins ISB Engine Test set forth in ASTM D7484-21b. The following zinc dihydrocarbyl dithiophosphate compounds were used in the antiwear systems of these fluids:

ZDDP1 was a zinc dihydrocarbyl dithiophosphate compound derived from primary alcohols and having an average degree of branching of 0.75, an average hydrocarbyl chain length of 8, and a Zn:P of 1.27.

ZDDP2 was a zinc dihydrocarbyl dithiophosphate compound derived from secondary alcohols and having an average degree of branching of 0.67, an average hydrocarbyl chain length of 6, and Zn:P weight ratio of 1.10.

ZDDP3 was a zinc dihydrocarbyl dithiophosphate compound derived from a mixture of primary and secondary alcohols (70 weight percent primary and 30 weight percent secondary) and having an average degree of branching of 0.73, an average hydrocarbyl chain length of 5.0, and Zn:P weight ratio of 1.10.

ZDDP4 was a zinc dihydrocarbyl dithiophosphate compound derived from primary alcohols and having an average degree of branching of 0.75, an average hydrocarbyl chain length of 8, and Zn:P weight ratio of 1.11.

ZDDP5 was a zinc dihydrocarbyl dithiophosphate compound derived from a mixture of primary alcohols and having an average degree of branching of 0.77, an average hydrocarbyl chain length of 4.3, and Zn:P weight ratio of 1.13.

The Inventive and Comparative lubricating compositions included the antiwear system as set forth in Table 3 below. Each lubricating composition included the same amounts of other additives including dispersants, antioxidants, organomolybdenum additives, antifoam, ashless antiwear additives, and an olefin copolymer viscosity modifier. The additives were blended in identical base oils, with only slight variations in base oil amounts such that each lubricant had a kV100 (ASTM D445) of about 9.5 to about 11.8 cSt. Accordingly, the only material change in each of the lubricants were the ZDDP additives used.

TABLE 3

Lubricants and ZDDP compounds

| | Inventive 1 | Compare 1 | Compare 2 | Compare 3 |
|---|---|---|---|---|
| ZDDP1 | — | — | 0.90% | — |
| ZDDP2 | 0.18% | 0.37% | 0.23% | — |
| ZDDP3 | 0.21% | — | — | — |
| ZDDP4 | — | 0.88% | — | — |
| ZDDP5 | — | — | — | 0.99% |

The fluids in Table 3 above were analyzed for zinc and phosphorus levels, as shown in Table 4. Table 4 also provides structural details of the ZDDP additives and/or the antiwear systems in the lubricants.

TABLE 4

Lubricants and Antiwear Systems

| | Inventive 1 | Compare 1 | Compare 2 | Compare 3 |
|---|---|---|---|---|
| Zinc, ppm (measured) | 340 | 877 | 943 | 881 |
| Phosphorus, ppm (measured) | 306 | 781 | 748 | 793 |
| Antiwear system Zn/P | 1.11 | 1.12 | 1.26 | 1.11 |
| Antiwear system average degree of branching (calculated) | 0.70 | 0.73 | 0.73 | 0.77 |
| Antiwear system average chain length (calculated) | 5.46 | 7.41 | 7.59 | 4.31 |

TABLE 4-continued

| Lubricants and Antiwear Systems | | | | |
|---|---|---|---|---|
| | Inventive 1 | Compare 1 | Compare 2 | Compare 3 |
| Antiwear system Wt % hydrocarbyl from Secondary Alcohol | 62.2% | 29.6% | 20.0% | 58% |

The Inventive and Comparative lubricants were evaluated for Average Cam Shaft Wear (ACSW) and for Average Tappet Mass Loss (ATWL) pursuant to the Cummins ISB Engine Test of ASTM D7484-21b. As defined by the API Engine Oil Classifications for Commercial Vehicle Engine Oil Requirements a CK-4 lubricant must have a maximum ACSW of 55 μm and a maximum ATWL of 100 mg. Pass/fail results are provided in Table 5 below.

TABLE 5

| Tappet and Camshaft Wear (ASTM D7484-21b) | | | | |
|---|---|---|---|---|
| | Inventive 1 | Compare 1 | Compare 2 | Compare 3 |
| Average Tappet Mass Loss (ATWL), mg | 89 (Pass) | 113.6 (Fail) | 106.6 (Fail) | 113.7 (Fail) |
| Average Camshaft Wear (ACSW), μm | 52 (Pass) | 60.6 (Fail) | 74.3 (Fail) | 35.3 (Pass) |
| Overall | Pass | Fail | Fail | Fail |

As shown in Tables 3 to 5 above, when the antiwear systems and lubricants have less than about 500 ppm of phosphorus and/or less than about 500 ppm of zinc, lubricants achieve passing tappet and camshaft wear performance when the average degree of branching, average chain length, the Zn:P weight ratio, and/or secondary alcohol content falls within the noted parameters of the Inventive antiwear systems as discussed throughout this disclosure. Fluids that do not meet such parameters, even with higher levels of zinc and/or phosphorus, still fail one or more of the valve train performance tests. The lubricants evaluated herein each included, on average, between about 2.9 and about 3.2 weight percent soot.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A medium or heavy-duty diesel engine crankcase lubricant to reduce valve train wear, the lubricant comprising:

one or more base oils of lubricating viscosity;

an antiwear system providing about 200 to about 500 ppm of phosphorus and/or about 200 to about 500 ppm of zinc from one or more overbased zinc dihydrocarbyl dithiophosphate compounds including hydrocarbyl groups bonded to a phosphorus atom through an oxygen linker;

wherein the hydrocarbyl groups of the antiwear system are provided from secondary alcohols or combinations of secondary and primary alcohols, wherein the hydrocarbyl groups have an average degree of branching of 0.2 to 0.72, at least about 50 weight percent of the hydrocarbyl groups are derived secondary alcohols, and wherein the hydrocarbyl groups of the antiwear system have an average chain length of 5 to 7 total carbons;

wherein the one or more overbased zinc dihydrocarbyl dithiophosphate compounds of the antiwear system herein have a zinc to phosphorous ratio of 1.0:1 to 1.12:1.

2. The medium or heavy-duty diesel engine crankcase lubricant of claim 1, wherein the antiwear system provides about 200 to about 350 ppm of phosphorus and/or about 200 to about 350 ppm of zinc.

3. The medium or heavy-duty diesel engine crankcase lubricant of claim 1, wherein at least about 60 weight percent of the hydrocarbyl groups in the antiwear system are derived from secondary alcohols.

4. The medium or heavy-duty diesel engine crankcase lubricant of claim 2, wherein about 60 weight percent to about 75 weight percent of the hydrocarbyl groups are derived from secondary alcohols.

5. The medium or heavy-duty diesel engine crankcase lubricant of claim 4, wherein the antiwear system includes hydrocarbyl groups provided from alcohols having an average degree of branching of 0.5 to 0.7.

6. The medium or heavy-duty diesel engine crankcase lubricant of claim 5, wherein the zinc to phosphorous ratio is 1.0:1 to 1.11:1.

7. The medium to heavy-duty diesel engine crankcase lubricant of claim 6, wherein the lubricant includes, on average, about 2.9 to about 3.2 weight percent soot.

8. The medium or heavy-duty diesel engine crankcase lubricant of claim 1, wherein the antiwear system includes hydrocarbyl groups provided from alcohols having an average degree of branching of 0.5 to 0.72.

9. The medium to heavy-duty diesel engine crankcase lubricant of claim 1, wherein the lubricant includes, on average, about 2.9 to about 3.2 weight percent soot.

10. A medium or heavy-duty diesel engine comprising:

a diesel engine crankcase configured for powering a vehicle weighing at least about 14,000 pounds, and wherein the medium or heavy-duty diesel engine includes an exhaust gas recirculation system;

a lubricant for the diesel engine crankcase including (i) one or more base oils of lubricating viscosity; and (ii) an antiwear system providing about 200 to about 500 ppm of phosphorus and/or about 200 to about 500 ppm of zinc from one or more overbased zinc dihydrocarbyl dithiophosphate compounds including hydrocarbyl groups bonded to a phosphorus atom through an oxygen linker; wherein the hydrocarbyl groups of the antiwear system are provided from secondary alcohols or combinations of secondary and primary alcohols, wherein the hydrocarbyl groups have an average degree of branching of 0.2 to 0.72, at least about 50 weight percent of the hydrocarbyl groups are derived secondary alcohols, and wherein the hydrocarbyl groups of the antiwear system have an average chain length of 5 to 7 total carbons; and wherein the one or more overbased zinc dihydrocarbyl dithiophosphate compounds of the antiwear system herein have a zinc to phosphorous ratio of 1.0:1 to 1.12:1.

11. The medium or heavy-duty diesel engine of claim 10, wherein the antiwear system provides about 200 to about 350 ppm of phosphorus and/or about 200 to about 350 ppm of zinc.

12. The medium or heavy-duty diesel engine of claim 10, wherein at least about 60 weight percent of the hydrocarbyl groups in the antiwear system are derived from secondary alcohols.

13. The medium or heavy-duty diesel engine of claim 12, wherein about 60 weight percent to about 75 weight percent of the hydrocarbyl groups are derived from secondary alcohols.

14. The medium or heavy-duty diesel engine of claim 13, wherein the antiwear system includes hydrocarbyl groups provided from alcohols having an average degree of branching of 0.5 to 0.7.

15. The medium or heavy-duty diesel engine of claim 14, wherein the zinc to phosphorous ratio is 1.0:1 to 1.11:1.

16. The medium or heavy-duty diesel engine of claim 15, wherein the lubricant includes, on average, about 2.9 to about 3.2 weight percent soot.

17. The medium or heavy-duty diesel engine of claim 10, wherein the antiwear system includes hydrocarbyl groups provided from alcohols having an average degree of branching of 0.5 to 0.72.

18. The medium or heavy-duty diesel engine of claim 10, wherein the lubricant includes, on average, about 2.9 to about 3.2 weight percent soot.

* * * * *